US005208927A

United States Patent [19]

Lachmar

[11] Patent Number: 5,208,927

[45] Date of Patent: May 11, 1993

[54] BEDDING APPARATUS COMPRISING A TOP SHEET, A BOTTOM SHEET AND A BLANKET

[76] Inventor: Edward B. Lachmar, 13342 Bow Pl., Tustin, Calif. 92705

[21] Appl. No.: 899,613

[22] Filed: Jun. 15, 1992

[51] Int. Cl.[5] ..... A47G 9/04; A47G 9/02

[52] U.S. Cl. ..... 5/497; 5/502; 5/923

[58] Field of Search ..... 5/497, 502, 500, 496, 5/498, 923

[56] References Cited

U.S. PATENT DOCUMENTS

| | | | |
|---|---|---|---|
| 2,572,490 | 10/1951 | Kaplan . | |
| 2,594,438 | 4/1952 | Howe . | |
| 2,702,385 | 2/1955 | Goldberg . | |
| 3,066,323 | 12/1962 | Kintner . | |
| 3,083,378 | 4/1963 | Pursell . | |
| 3,178,734 | 4/1965 | Carrez . | |
| 3,832,743 | 9/1974 | Smith . | |
| 3,857,124 | 12/1974 | Hadley | 4/496 |
| 4,169,428 | 10/1979 | Waugh | 5/485 |
| 4,316,299 | 2/1982 | Friedman | 5/502 |
| 4,339,835 | 7/1982 | Jaffe et al. | 5/502 |
| 4,413,368 | 11/1983 | Schuetze | 5/502 |
| 4,513,461 | 4/1985 | Tardivel | 5/502 |
| 4,605,029 | 8/1986 | Russell | 5/413 |
| 4,632,379 | 7/1987 | Dugan | 5/500 |
| 4,688,282 | 8/1987 | Jeffries | 5/494 |
| 4,970,744 | 11/1990 | Davis | 5/497 |
| 5,020,177 | 6/1991 | Etherington | 5/497 |

FOREIGN PATENT DOCUMENTS

| | | | |
|---|---|---|---|
| 1093969 | 12/1967 | United Kingdom | 5/502 |

*Primary Examiner*—Alexander Grosz
*Attorney, Agent, or Firm*—Edward E. Roberts

[57] ABSTRACT

A bed-roll type bedding apparatus comprising a contoured blanket member having a hook and eye section and a zipper section sewn in the outer periphery, a contoured top sheet member having a hook and eye section that mates with the hook and eye section of the blanket member with the top sheet member fitted inside the blanket member and a bottom fitted sheet member having a zipper portion that mates with the zipper portion of the blanket with the top sheet/blanket combination zippered to the bottom sheet member. The bottom fitted sheet member has a pad sewn on the undersurface of the main portion thereof, the sheet being formed to fit around and underlie the edges of the mattress or the like, with the periphery under tension, such as by means of elastic bands or the like sewn into a peripheral hem portion.

9 Claims, 2 Drawing Sheets

BEDDING APPARATUS COMPRISING A TOP SHEET, A BOTTOM SHEET AND A BLANKET

BACKGROUND OF THE INVENTION

The background of the invention will be discussed in two parts.

FIELD OF THE INVENTION

This invention relates to bedding apparatus, and more particularly to a bedding apparatus configured for ready attachment to a mattress.

DESCRIPTION OF THE PRIOR ART

Bedding apparatus generally takes the form of linens, such as sheets and pillowcases, as well as blankets. Various devices have been made to provide ease of removal of such bedding; to provide "sleeping bags" or lie apparatus using such bedding, or the like. Sleeping bags have become a very common extension of bedding and is used as a convenient form of portable bedding, many of such sleeping bags including compartments for insertion therein of an air mattress.

Whether the sleeping facility is portable or non-portable, the application or fitting, removal and laundering of bed linens, covers, sheets and blankets, has become a nuisance, if not a problem. Many attempts have been made to simplify this.

One such prior art apparatus is disclosed in U.S. Pat. No. 3,832,743 issued to Smith on Sep. 3, 1974, entitled "Bed Sheets", which relates to bed sheets wherein the top sheet and the fitted bottom sheet are connected together by means of hook and eye and zipper type fasteners.

Another such prior art device is shown and described in U.S. Pat. No. 3,066,323, entitled "Bedding", which issued to Kintner on Dec. 4, 1962, and refers to a bedding wherein the cover sheet is retained to the mattress by means of a hook and eye type fastener.

U.S. Pat. No. 4,339,835, entitled "Sleeping Sack", issued to Jaffe et al on Jul. 20, 1982 and relates to a sleeping sack wherein a plurality of layers are fastened together both by hook and eye type fasteners and also by zipper.

U.S. Pat. No. 4,513,461, entitled "Sleeping Bag With Removable Sheet", issued to Tardivel on Apr. 30, 1985, and discloses a sleeping bag having, not only a removable inner sheet liner but also relatively separable insulation and outer panels thereby enabling an insulation panel of a given weight to be substituted for by another insulation panel of a different weight.

U.S. Pat. No. 4,413,368, entitled "Combination Bedspread and Sleeping Enclosure", issued to Schuetze on Nov. 8, 1963, and discloses a bedspread made to form fit the associated mattress and includes a fastening element at the foot of the spread for receiving a cooperating fastening element secured transversely to the approximate midpoint of the sleeping enclosure, which is formed as a single elongated cover of about twice the length of the spread to be covered, the enclosure having oppositely disposed side fasteners which matingly coact on folding the enclosure on the line of the transverse fastening element.

U.S. Pat. No. 3,178,734, entitled "Bedding Article", issued to Carrez on Apr. 20, 1965, and discloses an assembly for forming a sleeping bag arrangement for a conventional bed with flat sheets, the sleeping bag being formed by two sheets assembled together and detachably secured by means of a slide fastener along at least two sides of the bag and in proximity with both longitudinal edges.

Other references uncovered in a novelty search include U.S. Pat. No. 2,594,438, issued to Howe On Apr. 29, 1952; U.S. Pat. No. 2,702,385, issued to Goldberg on Feb. 22, 1955; U.S. Pat. No. 2,572,490 issued to Kaplan on Oct. 23, 1951; U.S. Pat. No. 3,083,378 issued to Pursell on Apr. 2, 1963; U.S. Pat. No. 3,178,734 issued to Carrez on Apr. 20, 1965; U.S. Pat. No. 4,169,428 issued to Waugh on Oct. 2, 1979; U.S. Pat. No. 4,413,368 issued to Schuetze on Nov. 8, 1983; U.S. Pat. No. 4,513,461 issued to Tardivel on Apr. 30, 1985; U.S. Pat. No. 4,605,029 issued to Russell on Aug. 12, 1986; and U.S. Pat. No. 4,688,282 issued to Jeffries on Aug. 25, 1987.

In accordance with an aspect of the invention, it is an object of the invention to provide a new and improved bedding apparatus for use with existing mattresses.

SUMMARY OF THE INVENTION

The foregoing and other objects of the invention are accomplished by providing an easily assembled bedding apparatus dimensioned, configured and arranged to be fitted, in a matter of minutes, to a conventional mattress of any size.

The bedding apparatus is comprised of three pieces: a contoured blanket member; a contoured top sheet member, configured for mating within and attachment to the interior of the blanket member by suitable fasteners; and a bottom fitted sheet member with a sewn in pad to which the blanket member and top sheet member can be attached, such as by use of a slide fastener attached to the hem of the blanket member for engagement with a mating slide fastener about a portion of the perimeter of the bottom sheet member. The combination allows the user to detach the top and bottom sheet members for laundry without cleaning the blanket member nearly as often.

Other objects, features and advantages of the applicant's invention will become readily apparent from a reading of the specification, when taken in conjunction with the drawings, in which like reference numerals refer to like elements in the several views.

DESCRIPTION OF THE PREFERRED EMBODIMENT

Figure 1:
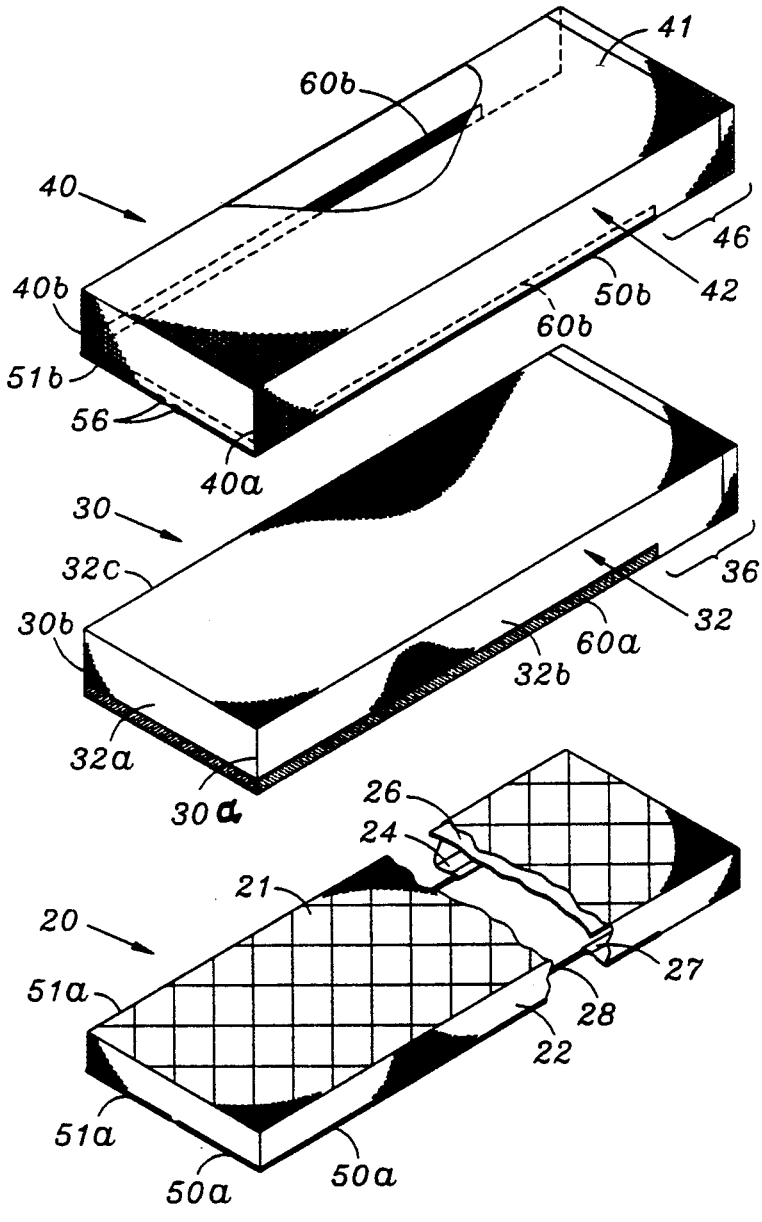
FIG. 1 is an exploded perspective view of the bedding apparatus according to the invention, with portions thereof broken away to show, inner details.

Referring now to the drawings, and particularly to FIG. 1, there is shown a bedding apparatus which broadly includes a bottom fitted sheet member 20, a contoured top sheet member 30 and a contoured blanket member 40. As will be hereinafter described, the top sheet member 30 is configured and dimensioned for being received within the blanket member 40 and suitably attached thereto, with the thus-attached combination, in turn, being configured and dimensioned for attachment to the fitted bottom sheet member 20, which in turn, is fitted to a mattress of corresponding size.

The bottom sheet member 20 is a "fitted" sheet, that is, it has a rectangular main portion 21 of approximately the same dimensions as the sleeping surface of the mattress 12 (See FIGS. 2–4) and a peripheral skirt portion 22 attached thereto to form box-like corners. The peripheral skirt portion 22 has a sufficient depth which exceeds the depth of the mattress to allow excess material for forming a peripheral underhang portion 24.

Although FIG. 1 does not show the mattress 12, the orientation of the parts of the bottom skirt member are oriented as though affixed to the mattress, that is the peripheral skirt portion 22 depends from the main portion 21 at about a right angle, with the underhang portion encircling a short distance beneath the mattress in the plane of the lower surface of the mattress. For comfort purposes, a pad 26 is sewn to the undersurface of the main portion 21 of the sheet member 20.

Figure 3:
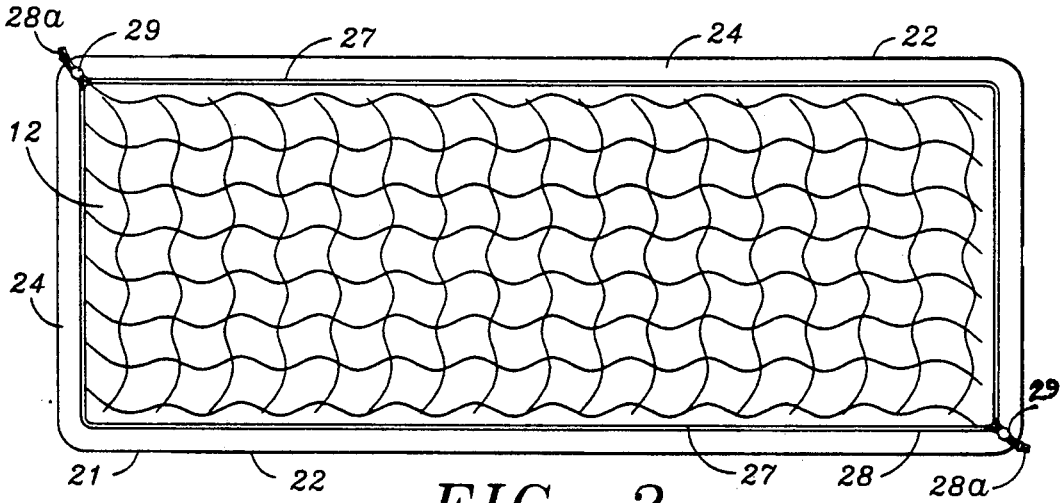
FIG. 3 is a bottom plan view of the bottom sheet member of the bedding apparatus fitted to the mattress.

Referring also to FIG. 3, for affixation to the mattress 12, the terminal end of the underhang 24 is provided with an open hem portion 27, through which is threaded a pair of elastic members 28, each being of a length sufficient to encompass one-half the perimeter of the underhang 24. The free ends 28*a* of the elastic members 28 are passed through slide lock members 29 to form a drawstring at diagonally opposite corners for enabling adjustment of the tension of the elastic members 28. With the sheet member 20 fitted to the mattress 12, this arrangement provides full encirclement of the underside of the mattress by both the underhang and the elastic members 28, thus providing a sturdy fitting bottom sheet member 20.

For reference purposes, and with reference to the orientation of the parts as shown in FIG. 1, the right ends of the parts will be referred to as the "head" ends, and the left ends will be referred to as the "foot" ends. For attachment purposes, the lower edge of the skirt portion 22 of sheet 20, at the junction with the underhang 24, is provided with two first sections 50*a*, 51*a* of a separable "zipper" or slide fastener 50, 51. The other mating sections 50*b*, 51*b* are attached to the blanket member 40 as will hereinafter be described.

The slide fastener sections 50*a*, 51*a*, commence at about the center of the foot portion of the bottom sheet member 20, extending around the corners and up the sides a distance about twelve inches form the corners of the head end of the bottom sheet member 20; this distance being sufficient for exposure of the head of the person utilizing the bedding apparatus. For enabling attachment of the other halves or sections 50*b*, 51*b*, of the slide fasteners 50, 51, the attachment points of the sections 50*a*, 50*b* on the bottom sheet member 20 are separated by a short distance of about one inch.

The top sheet member 30 is a "contoured" sheet member, that is, it is somewhat box-like on three sides with sewn corners 30*a*, 30*b*, and is oontoured to overlie the bottom sheet member 20. The length of the main portion 31 of the top sheet member is about the same as, or a little larger than, the length of the main portion 21 of the bottom sheet member 20. The width, however, is about one and one half times as wide as that of the bottom sheet member 20 for obvious reasons, that is, to allow for the volume of the human body.

The top sheet member is provided with a skirt portion 32 about the foot portion 32*a* and the two side portions 32*b* and 32*c*. The lower edge of the skirt portion has affixed, such as by sewing, a suitable fastener section 60*a*, such as the "hook" or "eye" section of a hook and eye fastener assembly 60. This section 60*a* starts along one side portion 32*c* of the skirt portion 32, around the foot portion 32*a* and up the other side portion 32*b*, terminating a distance from the corners of the head end by a suitable distance, designated 36. This distance 36 is again, about twelve inches.

The blanket portion 40, in shape, size and dimensions, corresponds approximately to the shape, size and dimensions of the top sheet member 30. That is, it is box-like on three sides of the rectangular main portion 41 with sewn corners 40*a*, 40*b*; it has a depending skirt portion 42 configured similarly to the three-sided skirt configuration 32 of the top sheet member 30, with the depth of the skirt portions 32 and 42 being about equal and both being about the same depth, or slightly greater than the depth of the skirt portion 22 of the bottom sheet member 20; and the width of the main portion 42 corresponds to a width equal to or slightly greater than the width of the main portion 32 of the top sheet member, which is about one and one-half times the width of the main portion 21 of the bottom sheet member 20.

Sewn on the outer lower peripheral edges of the skirt portion 42 are the second halves or sections 51*a*, 51*b* of the slide fasteners 50, 51. They are sewn at locations corresponding to the coacting sections 50*a*, 51*a*, for engagement therewith with the main portions 21 and 41, in overlying relation. The slide fastener sections 50*b*, 51*b*, terminate a distance 46 from the head end of the blanket member 40, with the fastener sliders 56 being spaced a slight distance apart (about one inch) at the center of the foot end of the blanket member 40.

Sewn on the inside of the skirt portion 42 opposite the slide fastener is the other section 60*b* of the hook and eye hook and eye fastener 60. The length and placement of the section 60*b* corresponds to the length and placement of the section 60*a*, as well as the length and placement of the combined zipper sections 50*b*, 51*b*.

Figure 2:
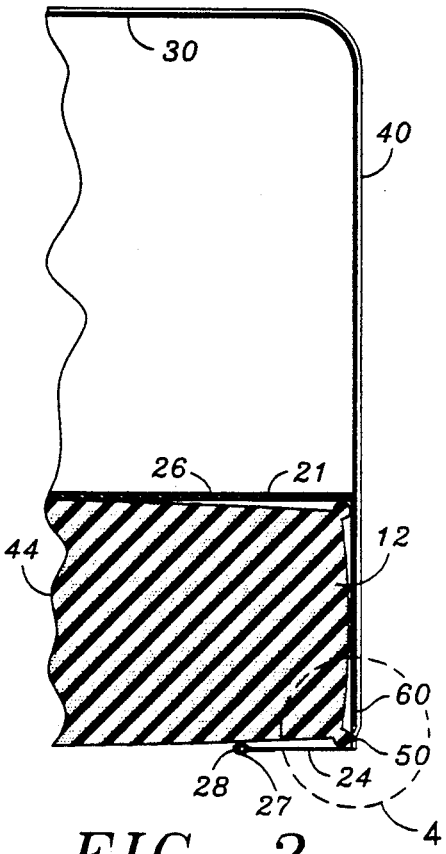
FIG. 2 is an enlarged end view, partially in cross-section and partially broken away, of the bedding apparatus of FIG. 1 fitted to a mattress with the members shown in connected relation.
Figure 4:
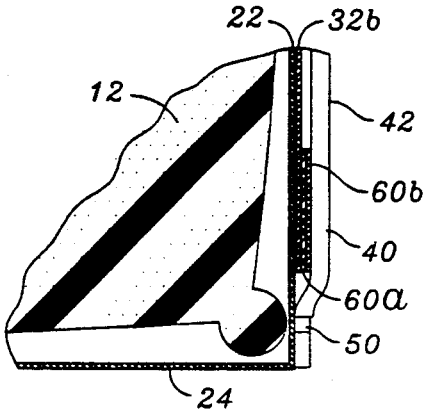
FIG. 4 is an enlarged corner view of a portion of the section of FIG. 3, taken within the broken line circle 4 thereof.

Referring now also to FIGS. 2 through 4, FIG. 4 illustrates the manner in which the contoured top sheet member 30 is fitted into the interior of the contoured blanket member 40. This is done by coupling the hook and eye sections 60*a* and 60*b* together, with the corners 30*a* and 30*b* at the foot end of the top sheet member 30 fitted snugly into the corresponding inside corners 40*a*, 40*b* of the blanket member 40. Thereafter, the slide fasteners sliders 56 are utilized to couple the two pairs 50*a*, 51*a*, and 50*b*, 51*b* of the slide fasteners 50, 51 together to thereby attach the top sheet/blanket combination to the lower sheet member 20. The volume of the space for human occupancy is depicted in FIG. 2, that is a view from the head end of the bed mattress 12 with the parts of the bedding apparatus attached together and fitted to the mattress 12. The top sheet member 30 and blanket member 40 are shown in "stretched fitted" view to provide an indication of the widths thereof relative to the width of the main portion 21 of the bottom sheet member 20.

In accordance with the invention, there is provided a bedding apparatus which is easily assembled and will take just minutes to attach to the associated mattress. The combination allows the user to detach the less bulky top and bottom sheet members 30 and 20, respectively, for laundering without the need for laundering the blanket member 40 nearly as often.

The bottom fitted sheet member 20 has a pad 26 permanently sewn into the flat main portion 21 of the sheet member 20 for added comfort. It also contains elastic 28 all about the under periphery, rather than at just the corners as on sheets of current design, with the sliders 29 enabling adjustment of the tension by a drawstring effect. The side fasteners 50, 51 are heavy duty and washable, and sewn at the point where the sheet skirt 22 edge folds under the mattress 12.

The top sheet member 30, during construction, is cut at the foot end lower corners 30*a*, 30*b* so that the sheet, when fitted to the blanket 40 will fold over the mattress 12. The sheet material, in uncut form, is as long as the mattress 12 plus the mattress thickness or depth. The width is approximately 1.5 times the mattress 12 width for comfort.

The blanket member 40 can be selected from a variety of materials, depending on cost and warmth desired. Only one blanket is required. If additional warmth is desired, a comforter could be merely laid over the blanket and stuffed in easily. The blanket material would prevent the comforter from sliding off.

While there has been shown and described a preferred embodiment, it is to be understood that various other adaptations and modifications may be made within the spirit and scope of the invention.

What I claim is:

1. Bedding apparatus for use with a generally rectangularly configured box-like mattress or the like, said apparatus comprising:

a fitted bottom sheet member having a main portion configured to the sleeping surface of the mattress, a peripheral skirt portion contoured to the mattress and an underhang for extending peripherally beneath the edge of the mattress;

first fastening means on said peripheral skirt portion at the junction with said underhang;

a blanket member having a skirt portion configured for extending about both sides and the foot end of said mattress;

second fastening means on the skirt portion of said blanket member for coactingly engaging said first fastening means for releasably securing said blanket member to said bottom sheet member, said first and second fastening means having a length sufficient to extend across the foot end and the majority of opposite sides of the mattress;

a top sheet member contoured with a skirt portion to overlie said bottom sheet member and being configured for being receiving within said blanket member between said bottom sheet member and said blanket member; and other coacting fastening means on the skirt portions of said blanket member and said top sheet member for releasably securing said top sheet member within said blanket member.

2. The bedding apparatus of claim 1 wherein said blanket portion and said top sheet skirt portion have a main portion configured for overlying the main portion of said bottom sheet member and wherein the width of the main portions of said blanket member and said top sheet member are about one and one-half times the width of the main portion of said bottom sheet member.

3. The bedding apparatus of claim 2 wherein said fitted bottom sheet member is formed to fit around and underlie the edges of said mattress with the periphery of said fitted sheet member having a hem portion with a pair of elastic members each threaded through an opposite one half of said hem portion at diagonally opposite corners thereof to form a drawstring and including slide lock members for engaging the free ends of said elastic members at each said opposite corners for adjusting the tension of said drawstring.

4. The bedding apparatus of claim 3 wherein said first and second fastening means are slide fasteners.

5. The bedding apparatus of claim 4 wherein said other fastening means are mating hook and eye fasteners.

6. Bedding apparatus for use with a generally rectangularly configured box-like mattress or the like, said apparatus comprising:

a contoured blanket member having a three sided depending skirt portion and including a hook or eye section affixed to a portion of the inner side of the periphery of said skirt portion and a slide fastener section affixed to a portion of the outer side of the periphery of said skirt portion;

a contoured top sheet member having a hook or eye section that releasably mates with the hook or eye section of said blanket member with said top sheet member fitted inside said blanket member; and a mattress contoured bottom fitted sheet member having a skirt portion and an overhang for extending beneath the edge of said mattress and a slide fastener portion at the intersection of said skirt portion and said underhang that releasably mates with the slide fastener portion of said blanket with the top sheet/blanket combination contoured to said bottom sheet member.

7. The bedding apparatus of claim 6 wherein said blanket and said top sheet skirt each have a main portion configured for overlying the main portion of said bottom sheet member, the width of said main portions of said blanket member and said top sheet member are about one and one-half times the width of the main portion of said bottom sheet member.

8. The bedding apparatus of claim 7 wherein said bottom fitted sheet member has a pad sewn on the undersurface of the main portion thereof, said sheet member being formed to fit around and underlie the edges of the mattress, with the periphery of said fitted sheet member having a hem portion with elastic tension adjustment means therein for providing a secured contoured fitting of said fitted sheet member to said mattress.

9. The bedding apparatus of claim 8 wherein said tension adjustment means includes a pair of elastic members each threaded through an opposite one half of said peripheral hem at diagonally opposite corners thereof to form a drawstring and including slide lock members for engaging the free ends of said elastic members at each said opposite corners for adjusting the tension of said drawstring.

* * * * *